US005655936A

United States Patent [19]

Meredith

[11] Patent Number: 5,655,936

[45] Date of Patent: Aug. 12, 1997

[54] SELF LOCKING, CONSTANT PRESSURE ELECTRICAL TERMINAL FOR THREADED STUDS

[75] Inventor: Mark C. Meredith, Pinckney, Mich.

[73] Assignee: Yazaki Corporation, Tokyo, Japan

[21] Appl. No.: 575,666

[22] Filed: Dec. 18, 1995

[51] Int. Cl.[6] ..... H01R 4/30

[52] U.S. Cl. ..... 439/801; 439/883

[58] Field of Search ..... 439/801, 813, 439/883, 860

[56] References Cited

U.S. PATENT DOCUMENTS

| | | | |
|---|---|---|---|
| 2,199,626 | 5/1940 | Freese | 439/801 |
| 5,575,697 | 11/1996 | Kaedei | 439/883 |

FOREIGN PATENT DOCUMENTS

| | | | |
|---|---|---|---|
| 5435397 | of 0000 | Japan . | |
| 1150374 | of 0000 | Japan . | |
| 5891876 | of 0000 | Japan . | |
| 1301161 | 12/1972 | United Kingdom | 439/801 |

*Primary Examiner*—Gary F. Paumen

*Attorney, Agent, or Firm*—Young & Basile, P.C.

[57] ABSTRACT

A terminal assembly for a threaded stud or the like which can be tightened onto the stud in a one-handed operation and which promotes constant tightening force. The terminal assembly comprises a bowed washer-like terminal adapted to be connected to, for example, a battery cable and having an aperture therein which permits the terminal to be placed in surrounding relationship to the stud. A nut has an external, axially extending sleeve concentric with the central threaded aperture which extends through the aperture in the terminal and is flanged so as to be retained in loose relationship with the terminal. Tightening the nut on the stud tends to flatten the terminal against the reaction surface immediately around the base of the stud.

15 Claims, 3 Drawing Sheets

SELF LOCKING, CONSTANT PRESSURE ELECTRICAL TERMINAL FOR THREADED STUDS

FIELD OF THE INVENTION

The present invention relates to electrical contacts and more particularly to a contact assembly for threaded studs or bolts which assures a predictable contact pressure.

BACKGROUND OF THE INVENTION

A prior art method for securing a washer-like conductor terminal to a threaded stud involves placing the terminal around the stud and holding it in place with a conventional nut. This arrangement requires the user to maintain an inventory of both terminals and nuts and to handle both components at and en route to the point of installation. Moreover, it requires the installer to take extraordinary care in torquing the nut to ensure that the proper tightening forces are created.

Another type of battery terminal is illustrated in Japanese utility model number 54-35397. That reference discloses a nut having a peripheral flange extending radially outward. The terminal has a series of straps which loosely hold the nut to the terminal by wrapping around the flange extending from the nut. This arrangement requires a specially manufactured nut having a radial flange as well as a specially manufactured terminal having the necessary straps to wrap around the flange.

Another type of known battery terminal uses a lock washer positioned between the terminal and the nut, to prevent loosening of the nut once it has been attached to the battery post. However, this structure adds a third component, thereby increasing the number of parts to be maintained in inventory, and adding complexity to the assembly operation.

SUMMARY OF THE INVENTION

According to the present invention there is provided a self-locking electrical terminal for threaded studs, battery posts and the like which reduces part inventory and handling requirements, which is installable in a one-handed operation, and which promotes a predictable application pressure by reducing the likelihood of over tightening.

In general the objectives of the invention are achieved through the provision of an assembly comprising a bowed, washer like terminal adapted to be placed in surrounding relationship to, for example, a threaded stud or terminal and which carries in loosely integrated association therewith a captive nut having a cylindrical extension sleeve concentric with the thread axis. The nut sleeve extends through the aperture in the terminal and is retained by means of an end flange. In this arrangement the nut can be turned independently of the terminal until a desired degree of flattening of the bowed terminal occurs. The bowed terminal also provides a tensioning in the fastener structure which operates as a self-locking feature.

DETAILED DESCRIPTION OF THE PREFERRED EMBODIMENT

Figure 1:
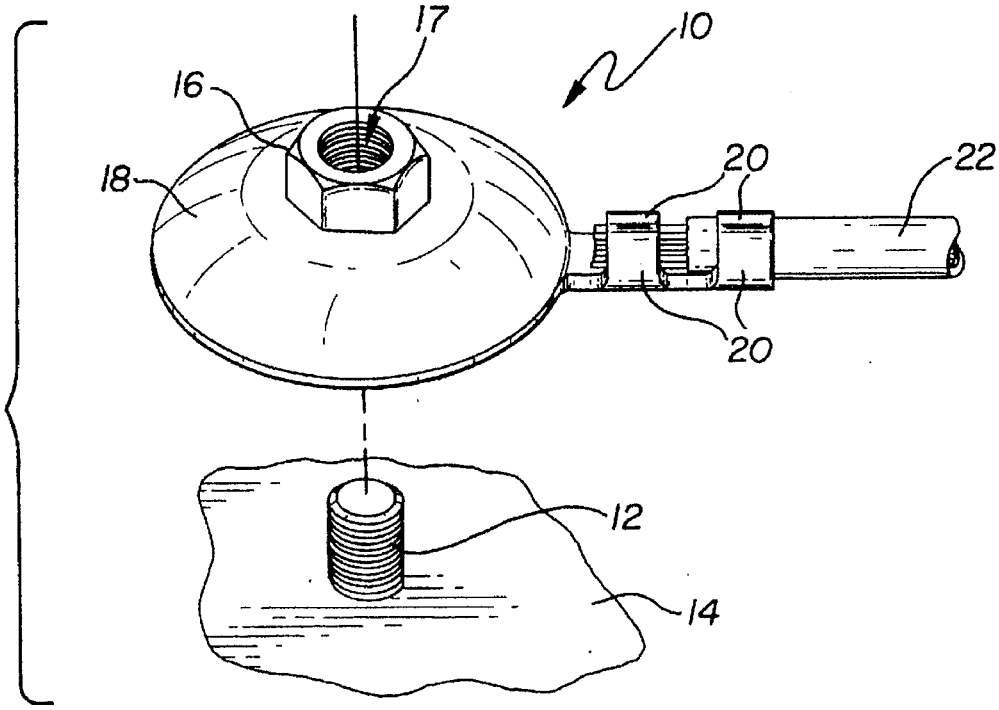
FIG. 1 is a perspective view of an assembled nut and terminal assembly of the present invention and a threaded battery post.

FIG. 1 illustrates a terminal assembly 10 adapted for installation on a threaded stud-like battery post 12 extending from a battery terminal surface 14. Assembly 10 includes a nut 16 having conventional flats for engagement with a turning tool and a threaded aperture 17 extending through the nut. Nut 16 is attached to a terminal 18 having a plurality of crimp tabs 20 extending from the terminal crimp tabs 20 are compressed around a wire or cable 22 to provide electrical contact between the cable and the terminal. The thread pattern within aperture 17 is compatible with the thread pattern on post 12.

Terminal 18 is made from a resilient, conductive material such as stainless steel or a steel copper alloy. The conductivity of the material is required due to its function of conducting electrical current from the battery post 12 to cable 22. The resiliency is necessary for a locking function to be described.

Figure 2:
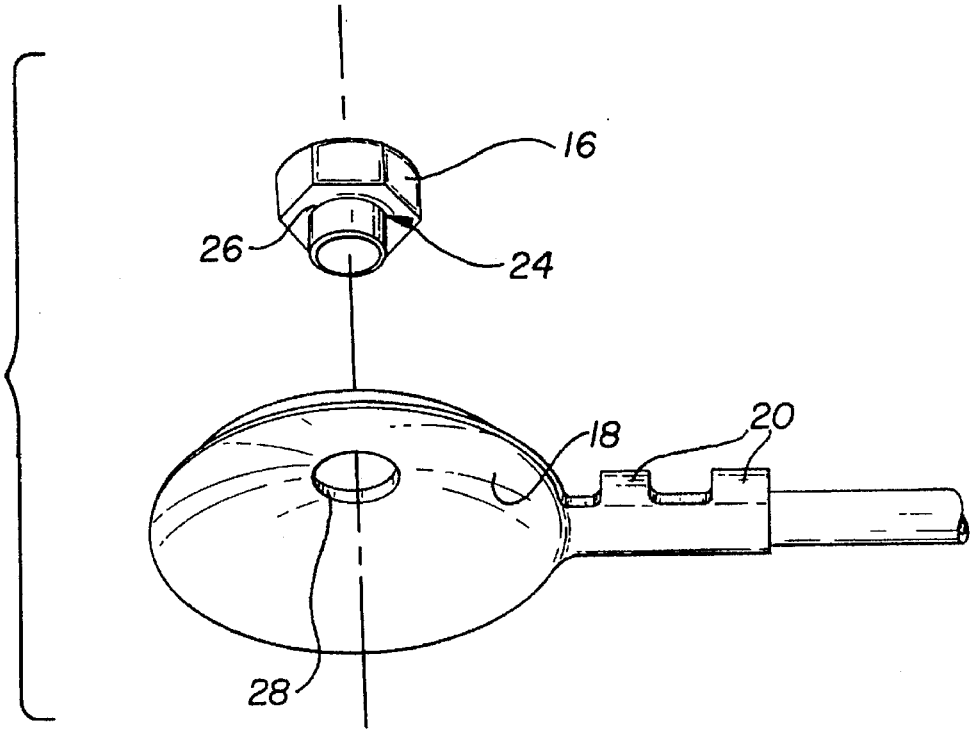
FIG. 2 is a perspective view of the nut and terminal according to the present invention prior to assembly.

Referring to FIG. 2, nut 16 includes a sleeve 24 extending axially from the nut around the perimeter of threaded aperture 17. In one embodiment, sleeve 24 is integrally formed with nut 16 during the manufacturing process. In a second alternative embodiment, a slot 26 positioned axially along the perimeter of aperture 17 provides a location for press-fitting sleeve 24 into nut 16 during a separate operation.

As illustrated in FIG. 2, sleeve 24 extends from nut 16 and aligns with an aperture 28 in terminal 18. The outer diameter of sleeve 24 is slightly smaller than the diameter of aperture 28, permitting axial rotation between the nut and terminal.

Figure 3:
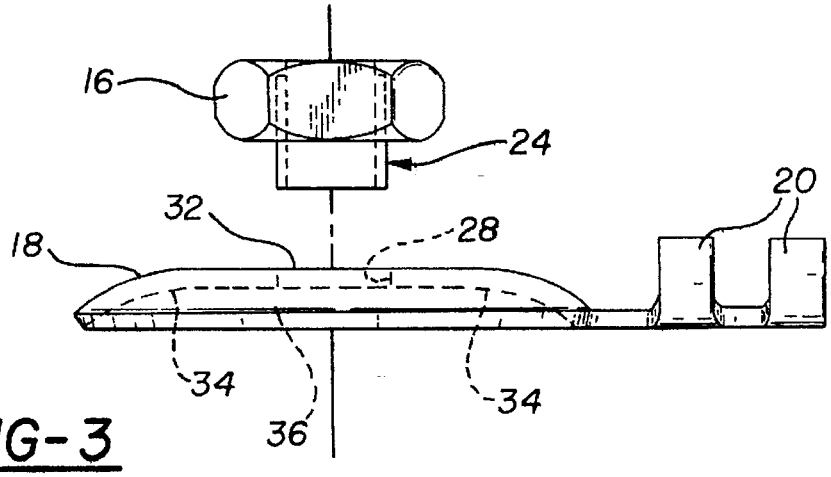
FIG. 3 is a side view of the nut and terminal prior to securing the nut to the terminal.

Referring to FIG. 3, terminal 18 is of bowed configuration; i.e., it has a first terminal surface 34 having a concave shape and defining a cavity 36. A second terminal surface 32 is located opposite the concave terminal surface.

Figure 4:
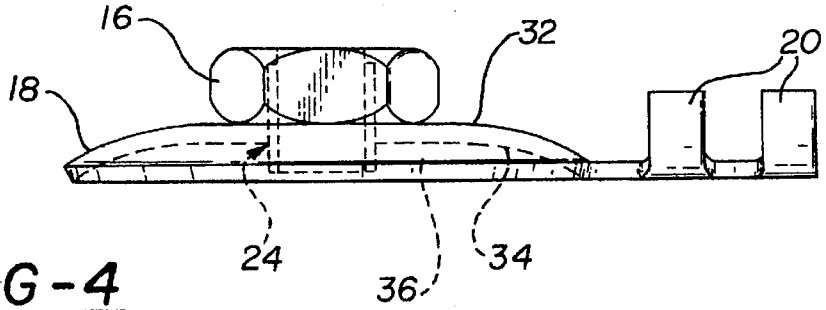
FIG. 4 is a side view of the nut and terminal after inserting the nut sleeve into the terminal aperture, but before flanging the sleeve.

During the assembly procedure, nut 16 is positioned above terminal surface 32 such that sleeve 24 is in alignment with terminal aperture 28, as seen in FIG. 3. Nut 16 is then moved toward terminal 18 such that sleeve 24 is inserted through aperture 28, as seen in FIG. 4. In this position, nut 16 lies flat against terminal surface 32, and sleeve 24 extends into cavity 36.

Figure 5:
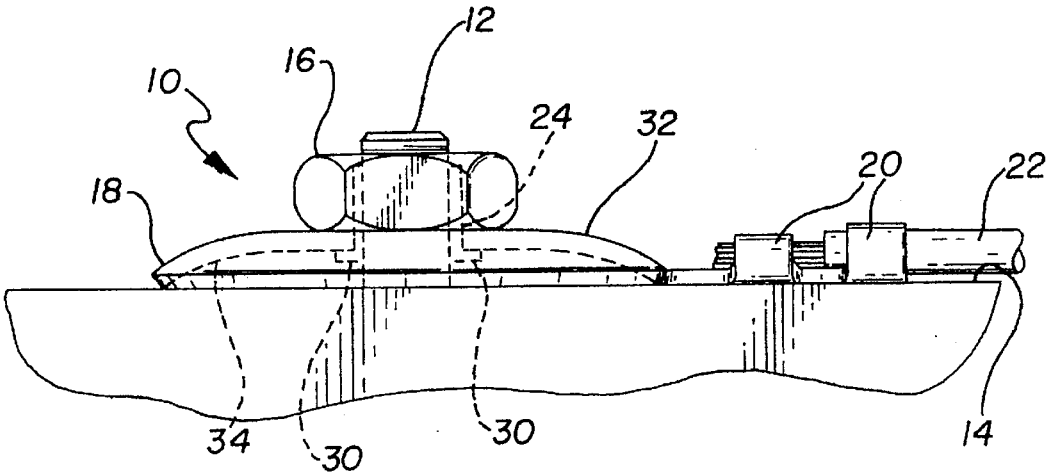
FIG. 5 is a side view of the nut secured to the terminal.

Referring to FIG. 5, sleeve 24 is then deformed radially outward at its distal end to form a flanged end 30. Flanged end 30 serves to retain nut 16 in a captive relationship with terminal 18, with the nut free to rotate relative to the terminal. Flanged end 30 is flush against concave surface 3 at the point where the concave surface meets aperture 28.

Terminal 18 is crimped to cable 22, as shown in FIG. 5. This attachment of wire 22 to terminal 18 is a conventional crimping procedure whereby crimp tabs 20 are bent and compressed around the cable, thereby securing the cable in electrical contact with the terminal.

After the cable has been attached to the terminal, the assembly is aligned with battery post 12 such that the battery post extends within said sleeve until reaching the threaded portion of nut 16. At that point, nut 16 is rotated to thread the nut onto the battery post. FIG. 5 illustrates that position of terminal 18 with respect to mounting surface 14 when the terminal has just come in contact with the mounting surface, with flanged end 30 spaced apart from mounting surface 14.

Figure 6:
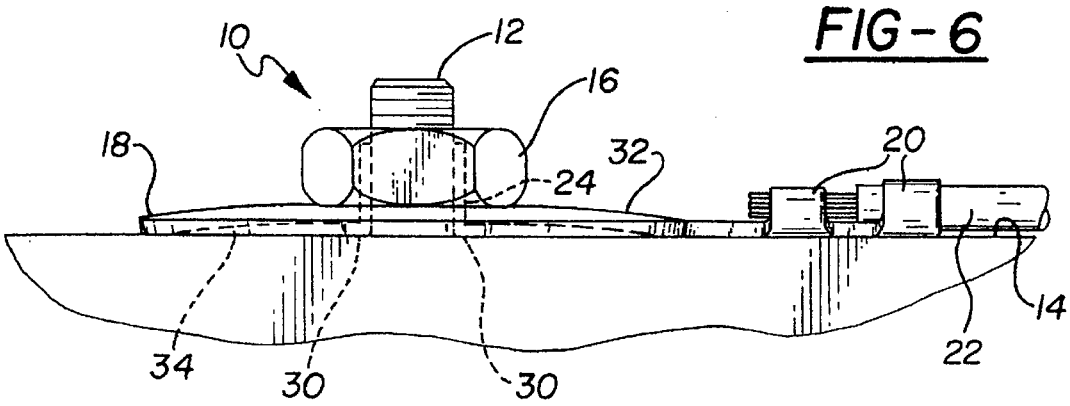
FIG. 6 is a side view of the nut and terminal assembly of FIG. 5 secured to a threaded battery post.
Figure 7:
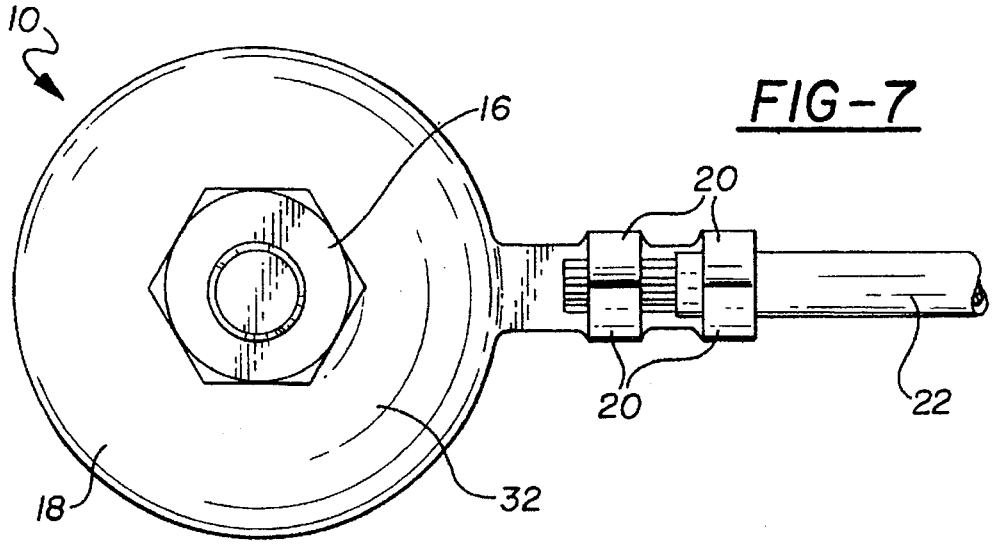
FIG. 7 is a top view of the nut and terminal assembly according to the present invention.
Figure 8:
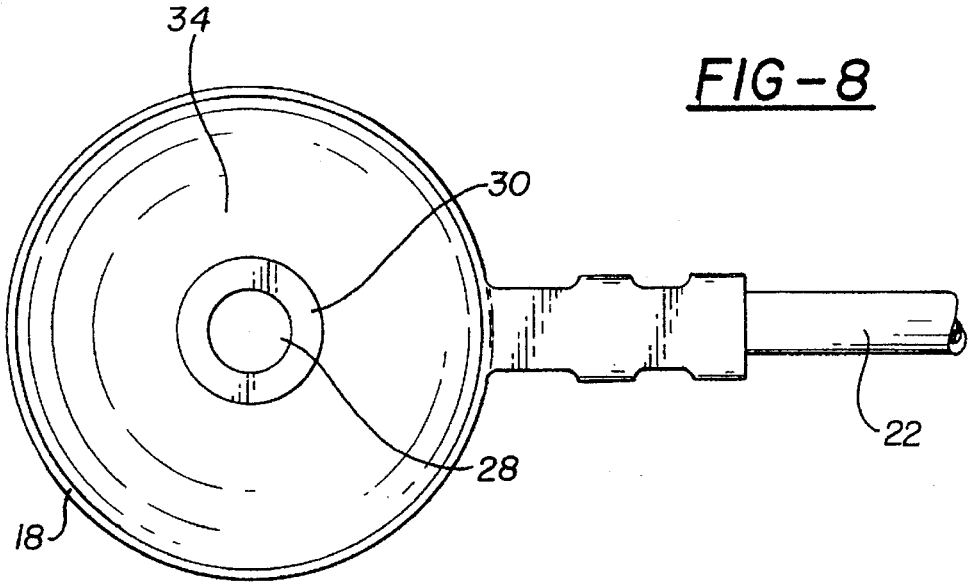
FIG. 8 is a bottom view of the nut and terminal assembly.

As nut 16 is further tightened on post 12, terminal 18 is flattened downwardly toward mounting surface 14. As shown in FIG. 6, the downward force applied by nut 16 causes concave surfaces 34 to flatten downwardly toward mounting surface 14. When nut 16 is tightened to the appropriate level, flanged end 30 is in contact with mounting surface 14. When flanged end 30 is trapped between first terminal surface 34 and mounting surface 14, cavity 36 is still concave, but to a lesser degree than before nut 16 is tightened. This slightly concave shape along with the resiliency of terminal 18 causes the terminal to secure nut 16 onto post 12. This locking feature operates in a fashion similar to that of a lock washer. Flanged end 30 prevents concave surfaces 34 from being completely flattened against mounting surface 14.

Furthermore, flanged end 30 prevents nut 16 from being over-tightened onto terminal 18. As shown in FIG. 6, when flanged end 30 contacts mounting surface 14, the nut 16 can no longer be tightened onto post 12. Further tightening of nut 16 would require the flanged end 30 to be forced below mounting surface 14 and into the battery or power distribution box. By preventing this over-tightening, consequential damage to the terminal is thereby avoided.

While described with reference to a battery terminal, the invention can be used to advantage in many other applications including, by way of example, a power distribution box.

What is claimed is:

1. A terminal assembly for externally threaded studs comprising in combination:

a washer-like terminal body having an aperture formed therein for loosely surrounding the stud;

said terminal body being bowed to provide flexure thereof when urged against a reaction surface proximate the stud; and a nut having a bearing surface, an internally threaded aperture and a cylindrical sleeve concentric with said threaded aperture, said sleeve extending axially of said nut beyond said bearing surface and having a distal end;

said sleeve being flanged at the distal end so as to be retained within the terminal body but rotatable relative thereto, whereby tightening the nut on the stud with the bearing surface against the terminal body tends to flatten the terminal against said reaction surface.

2. A terminal assembly as defined in claim 1 wherein said nut has external flats for engagement by a turning tool.

3. A terminal assembly as defined in claim 1 wherein said stud and said reaction surface form an electrical terminal.

4. A terminal assembly for securing an electrical cable to a threaded post extending from a mounting surface, said terminal assembly comprising:

a conductive terminal having an aperture therein for receiving said threaded post, said terminal including a first surface having a concave shape and an opposite second surface;

a nut having a threaded aperture therethrough, said nut adapted to be attached to said threaded post and tightened against the second terminal surface;

a cylindrical sleeve extending axially from said nut around the threaded aperture in said nut, said sleeve adapted to be inserted through said aperture in said terminal;

means for securing said nut to said terminal such that said nut may be rotated with respect to said terminal; and means for securing said cable in electrical contact with said terminal.

5. The terminal assembly of claim 4 wherein the concave shape of said first terminal surface defines a cavity and said cylindrical sleeve extends into said cavity.

6. The terminal assembly of claim 4 wherein said cylindrical sleeve has a first end positioned within said aperture in said nut and an opposite second end, said means for securing said nut to said terminal comprising a flanged second end of said sleeve, said second end of said sleeve flanged against said first terminal surface.

7. The terminal assembly of claim 6 wherein said flanged second end of said cylindrical sleeve contacts said mounting surface as said nut is tightened on said threaded post.

8. The terminal assembly of claim 4 wherein said terminal is resilient and the concave shape of said first terminal surface is partially flattened toward said mounting surface as said nut is tightened on said threaded post, said partial flattening of said terminal preventing loosening of said nut from said post.

9. The terminal assembly of claim 4 wherein said aperture in said terminal includes a peripheral edge where said aperture meets said first terminal surface, said cylindrical sleeve being flanged around said peripheral edge and against said first terminal surface for securing said nut to said terminal.

10. The terminal assembly of claim 4 wherein said aperture in said nut defines a peripheral surface, said nut further including a slot disposed around said peripheral surface for receiving said cylindrical sleeve in secure engagement therewith.

11. The terminal assembly of claim 4 wherein said cylindrical sleeve is integrally formed with said nut.

12. The terminal assembly of claim 4 wherein said means for securing said cable in electrical contact with said terminal comprises a plurality of crimp tabs extending from said terminal.

13. A terminal assembly for securing an electrical cable to a post extending from a mounting surface, said terminal assembly comprising:

a resilient conductive terminal defining an aperture for receiving said post, said terminal including a first surface having a concave shape and an opposite second surface;

means attachable to said post for urging said first terminal surface toward said mounting surface and securing said terminal to said post, said resilient terminal preventing release of said urging means therefrom; and means for joining said conductive terminal to said urging means.

14. The terminal assembly of claim 13 wherein said concave shape of said first terminal surface defines a cavity, said joining means extending into said cavity for abutting against said mounting surface when said urging means urges said first terminal surface toward said mounting surface.

15. A terminal assembly for securing an electrical cable to a threaded post extending from a mounting surface, said terminal assembly comprising:

a conductive terminal defining an aperture for receiving said threaded post, said terminal including a first surface having a concave shape and an opposite second surface, the concave shape of said first terminal surface defines a cavity;

a nut having a threaded aperture therethrough, said nut adapted to be attached to said threaded post and tightened against the second terminal surface;

a cylindrical sleeve extending axially from said nut around the threaded aperture in said nut, said sleeve adapted to be inserted through said aperture in said terminal and extend into said cavity, said sleeve having a first end positioned within the aperture in said nut and an opposite second end being flanged against said first terminal surface such that said nut may be rotated with respect to said terminal; and a plurality of crimp tabs extending from said terminal for securing said cable in electrical contact with said terminal.

* * * * *